United States Patent [19]

Levinson et al.

[11] Patent Number: 4,611,198

[45] Date of Patent: Sep. 9, 1986

[54] SECURITY AND COMMUNICATION SYSTEM

[76] Inventors: Samuel H. Levinson, 182 Maple Hill Rd., Glencoe, Ill. 60022; Jack R. Caldicott, 28461 W. Kelsey Ct., Barrington, Ill. 60010

[21] Appl. No.: 777,770

[22] Filed: Sep. 19, 1985

[51] Int. Cl.[4] ..... G08B 1/08

[52] U.S. Cl. ..... 340/539; 340/531; 340/536

[58] Field of Search ..... 340/539, 531, 536, 345, 340/346; 455/1, 7, 9, 11, 12, 13

[56] References Cited

U.S. PATENT DOCUMENTS

| | | | |
|---|---|---|---|
| 2,135,476 | 11/1938 | Rugh | 340/539 |
| 3,440,635 | 4/1969 | Hull | 340/539 |
| 3,594,748 | 7/1971 | Grotjahn | 340/539 |
| 3,825,833 | 7/1974 | Bogue et al. | 340/539 |
| 3,914,692 | 10/1975 | Seaborn, Jr. | 340/539 |
| 3,925,763 | 12/1975 | Wadhwani et al. | 340/539 |
| 4,083,003 | 4/1978 | Haemmig | 340/539 |
| 4,121,160 | 10/1978 | Cataldo | 340/539 |
| 4,157,540 | 6/1979 | Oros | 340/539 |
| 4,189,721 | 2/1980 | Doell | 340/539 |
| 4,319,230 | 3/1982 | Fowler et al. | 340/539 |
| 4,347,501 | 8/1982 | Akerberg | 340/539 |
| 4,468,656 | 8/1984 | Clifford et al. | 340/539 |
| 4,495,495 | 1/1985 | Ormanns et al. | 340/539 |

OTHER PUBLICATIONS

Linear Alert, ET-1 and DX-12 catalog sheets, Linear Security Products Group, 1983.

*Primary Examiner*—Donnie L. Crosland
*Attorney, Agent, or Firm*—George H. Gerstman

[57] ABSTRACT

A security and communication system permits the location of signaling portable radio frequency transmitters which may be carried by individuals. If an individual signals with his portable frequency transmitter, a first signal is sent including a first individual identification code to identify the particular portable transmitter. The first signal is picked up by at least one of a plurality of radio frequency relays each positioned in a predetermined location. Such relays immediately transmit a second signal including the first identification code and also a second identification code to identify the individual relay that is transmitting the second signal. Thus the signal sent by the individual relay identifies the location and the specific identity of the particular portable radio frequency transmitter which is sending the signal.

19 Claims, 1 Drawing Figure

SECURITY AND COMMUNICATION SYSTEM

BACKGROUND OF THE INVENTION

There is a growing need in the world as we find it for both improved security and for improved communication capability. In many areas of the cities, in public transportation, on the highways, in large buildings after business hours, and in many other situations and areas, there is the occasional need to give an urgent alarm.

Because of the lack of this capability in areas such as deserted streets after dark and public transportation, such areas have become prime spots for the activities of violent criminals. If there were a system which made it possible for individuals to give an instant alarm, criminal activity would be greatly suppressed.

Furthermore, the need for signaling and communication goes beyond criminal activity. A security and communication net which covers a large area could be used in a multitude of ways for safety, as well as for other priority or urgent communication.

DESCRIPTION OF THE INVENTION

By this invention, a security and communication system is provided in which at least one portable radio frequency transmitter has means for sending a first signal including a first individual identification code to identify the portable transmitter, when actuated by the user. Preferably, it is contemplated for the portable radio frequency transmitters to be sized for personal portability, for example being of the size of a cigarette pack, a wrist watch, or a necklace pendant so that a large number of people will carry individual radio frequency transmitters, having separate, first individual identification codes, in their everyday business. The term "radio frequency" is not intended to be a limiting term, and may include any portion of the electromagnetic spectrum suitable for transmission of information over distances.

A plurality of radio frequency relays are also provided, each being positioned in a predetermined location, unlike the portable radio frequency transmitter. The radio frequency relays have means for receiving a first signal from any of the portable transmitters. Upon receiving such signal, a relay will immediately transmit a second signal including the first identification code from the first signal and a second identification code to identify the individual relay that is transmitting the second signal.

The receiving station for the second signal from a radio frequency relay may be central means for receiving the signal such as a police facility or the like, and/or the other local radio frequency relays may be adapted to receive the second signal and to report its receipt by means of an audio or visual signal.

The radio frequency relays are preferably spread out and spaced over an area in their positions so that no more than relatively few of the relays can be simultaneously actuated by receiving the first signal from the same portable transmitter. Preferably, the positioning is such that only one relay will pick up a signal from any one portable transmitter, although in some circumstances two or three relays may report the signal.

The radio frequency relays may be located around a city area, a public garage, in separate cars of mass transit or other trains, or in any other situation desired where an alarm may need to be given. Individuals come and go throughout the area, carrying their portable radio frequency transmitters in their pocket or purse, or as a necklace pendant, or any other desired way. In the event of an urgent situation arising, for example a mugging, a fire, or whatever it may be, one or more individuals seeing the situation activate their radio frequency transmitters to send out a first signal including the first individual identification code identifying the individual transmitter. A radio frequency relay receives the first signal, and immediately retransmits a second signal including the first identification code to identify the individual transmitter, plus a second identification code to identify the individual relay that is transmitting the second signal. This second signal may of course be as powerful a radio signal as necessary, or its second signal may travel over telephone lines or the like, since the relays are stationary and may be as large as necessary to effectively perform their function. The second signals may be transmitted to central means for receiving the signals, such as a police or security station, which may be equipped with microprocessor means for identifying and immediately displaying the location of any relay or relays activated, and also the identity of the transmitter sending the signal.

Thus, the location of the relay is immediately known, indicating the approximate location of the transmitter which sent the signal. At the same time, the identity of the transmitter is known, so that the owners are induced to exercise a certain amount of responsibility. Police or other agencies can be immediately sent to the scene.

Alternately or additionally, the radio frequency relays may each carry audible alarm means, plus control means to cause at least one relay adjacent a relay that receives a first signal to produce an audible alarm, while causing the relay directly receiving the first signal to remain silent. Thus, this arrangement serves as a silent alarm, where no alarm is given in the immediate vicinity of the person giving the alarm, but adjacent relays scattered around the area are actuated to alert people in the neighborhood of the difficulty.

Thus, if the radio frequency relays are in separate railroad or rapid transit cars, an individual seeing a crime in one of the cars will actuate his portable transmitter, with no alarm being set off in the car. However, in adjacent railroad or rapid transit cars the alarm will be set off. Thus, the motormen can signal for the police, or if police are present on the train, they will be immediately alerted.

Additionally, means may be provided to cause the audible alarm to identify the relay directly receiving the first signal. This can be done by a prearranged code of beeps, visual readout, or an electronic voice system governed by microprocessors, making use of technology which is currently well-known. Thus, the exact railroad car or other location can be identified.

Similarly, groups of shopkeepers or homeowners in city can be immediately alerted of a crisis in a neighboring shop or home, with radio frequency relays in each of their stores or homes sounding the audible alarm plus information as to the location of the alarm.

As a further possibility for the security and communication system of this invention, video recorder means are provided to monitor various preselected sites. Means are also provided, conventional to the art, for actuating the video recorder means when a radio frequency relay receives a first signal from a portable radio frequency transmitter. The video recorder may carry video tape to store what it records of the events that set off the alarm, or it may be one of a large number of video recorders which communicate with a monitoring screen in the police station or security section. It may be that there are so many video recorders that they are difficult to monitor, so the recorders do not record unless an alarm is sensed by a radio frequency relay. Then, the local video recorder is turned on, and the signal automatically sent to the central station so that the police or other personnel have a visual view of the situation simultaneously with the alarm itself.

In some circumstances, it may be that a large number of People carrying portable radio frequency transmitters may observe a crisis taking place at once. They may all reach for their transmitters and activate them in a period of a few seconds. Accordingly, the relays may have jamming detector means to filter out all competing first signals except for one signal (typically the strongest signal) in the event of simultaneous transmission of several first signals, whereby the relay transmits the first identification code of that one first signal.

As a further modification, the first signal may be in the form of a coded pulse of the duration of a fraction of a second (typically one-thousandth of a second or so). The jamming detector means may be modified and the relays may have memory means to receive and to store a plurality of differing first signals, since each of them, lasting only a thousandth of a second or so, may be separately received without interference from the other pulses in the usual circumstance, since ideally about 1,000 differing first signals could be received per second.

Sequential transmission means are then provided to cause the relays to sequentially transmit in the second signal the various first identification codes of the stored first signals so that, after the second signal gives notice of the alarm, all or most of the signals of the individual portable radio frequency transmitters may be individually identified, typically to the central means for receiving the signals from the relays for storage in microprocessor means and subsequent readout or printout for a permanent record.

The jamming detector may also activate its relay to send an alarm signal if a strong jamming signal on the proper frequency is received. This could thwart a criminal attempt to disable the system.

As a further modification, a transmitter may be provided for test response of the radio frequency relays. When the particular identifying number of the test transmitter is received by each relay, it would be programmed not to send an alarm, but to respond in an appropriate manner to indicate nominal functioning.

Likewise, a burglar or fire alarm may be connected locally to any of the radio frequency relays as may be desired.

As a further alternative, passengers on a airplane may be equipped with radio frequency transmitters with a radio frequency relay positioned in the pilot's cockpit. This can provide early warning of a hijacking or other difficulty.

Also vehicles, money bags, and the like may carry the radio frequency transmitters of this invention, each with their own identification code so that the vehicle or other item may be immediately identified at the central station via signals received from the relays. These particular radio frequency transmitters may be concealed in the vehicle or other item, and may be individually activatable by a strong coded signal broadcast throughout the area, which could be broadcast upon loss of the vehicle or other item. Alternatively, they may be manually activated. Once activated, the radio frequency transmitter continues its transmission so that the stolen article can be traced as it moves, by the particular relays that it activates.

It is understood that the state of the electronics art is advanced to a sufficient degree so that the various functions outlined herein can be readily embodied in electronic circuitry by those having normal skill in the art.

DESCRIPTION OF SPECIFIC EMBODIMENTS

Figure 1:
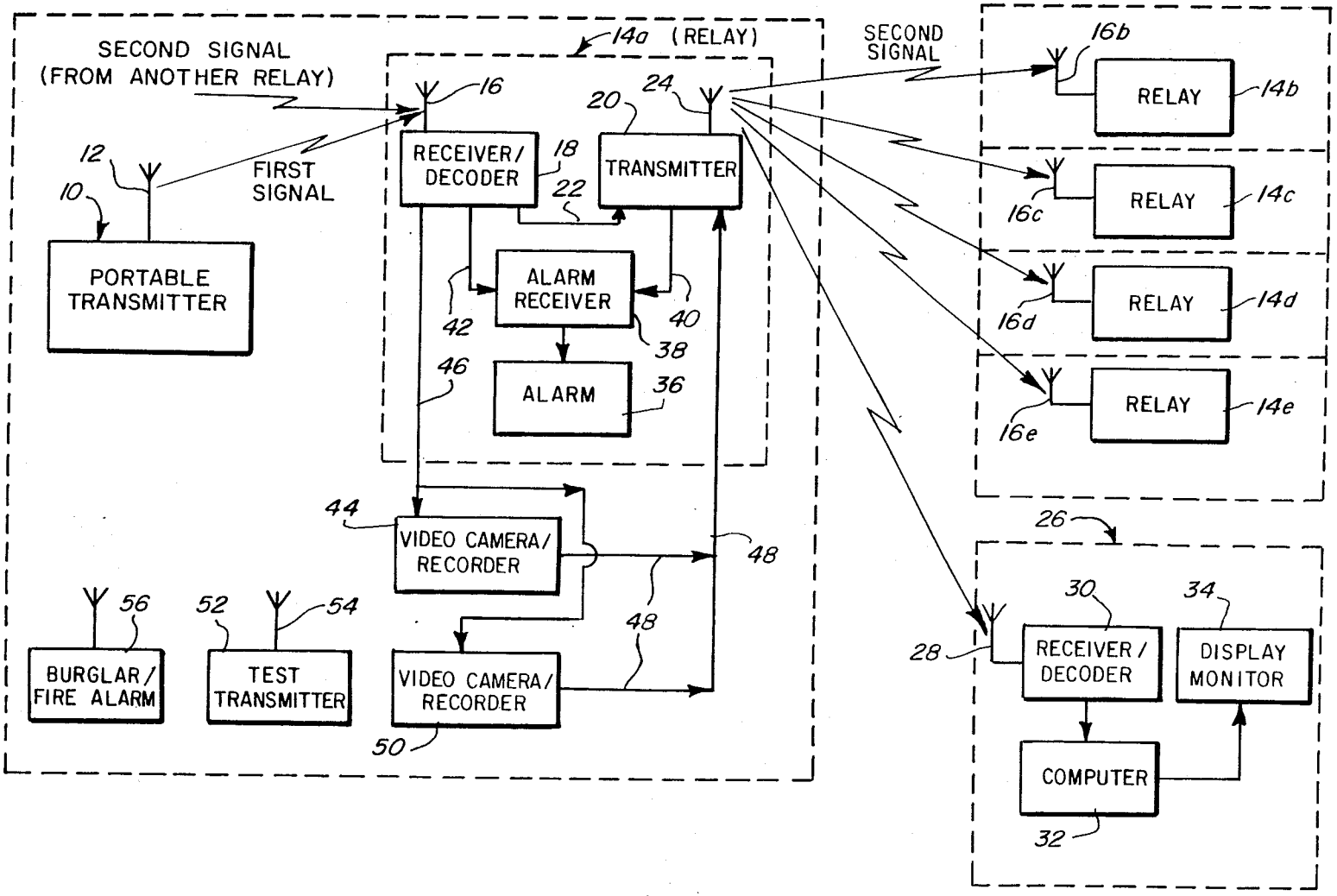
FIG. 1 is a diagramatic view of a security and communication system in accordance with this invention.

Referring to the drawing, a security and communication system is illustrated which comprises at least one portable radio frequency transmitter 10.

Portable transmitter 10 may be carried by a person, and may be the size and shape of a cigarette pack, a wrist watch, or a necklace pendant, for example. The ET-1 linear alert receiver, manufactured by Linear Electronics of Inglewood, Calif. illustrates the general type of technology that may be used for transmitter 10.

Transmitter 10, when activated by the wearer, transmits through antenna 12 a radio frequency signal which includes an identification code, so that the particular transmitter which is sending the signal can be identified. The identification code may be as long and complex as necessary to accommodate whatever number of individual transmitters are in the system, so that each individual transmitter can be identified from its transmission.

A series of radio frequency relays 14*a, b, c, d,* and *e* are positioned respectively in predetermined locations. For example, radio frequency relays may be positioned on street corners, in individual railroad cars, in halls of buildings, or the like. Each relay 14*a–e* may be of the specific design as shown for relay 14*a,* having an antenna 16 tuned to receive signals emitted by antenna 12 of each transmitter 10. Typically, relays 14*a–e* are spread out to a degree sufficient that only one relay will be in a position to sense an individual signal from a transmitter 10, or at the most only 2 or 3 relays.

Radio frequency relays may be of a design similar to the DX-12 receiver, also manufactured by Linear Electronics, modified as desired in ways clear to those skilled in the art to accomplish the purposes of this invention.

The signal from transmitter 10 received by antenna 16 is picked up by receiver decoder means 18 which may be of conventional design to decode the signal and to send it through conductor 22 to transmitter encoder 20. From there, a signal is dispatched through antenna 24 which incorporates the identification code received from transmitter 10, and also includes the individual identification code of the specific radio frequency relay which received the signal from transmitter 10. From antenna 24, or, alternatively through a telephone line or the like. the signal may be transmitted to central receiving station 26, which may be located at a police station, a security room, or the like. Alternatively or additionally, the signal from antenna 24 may be receivably by at least some of other relays 14*b*–14*e*. The signal from antenna 24 may be distinguishable from the signal from antenna 12, for example by use of a different frequency.

The signal is thus received by antenna 28 of central receiving station 26, and at that point it is conveyed to receiver-decoder 30. A signal is then sent to computer or microprocessor 32 for logging the date, the time, and the various first and second identification codes received in the signal. From there, the critical data is displayed on display monitor 34, including the exact location of relay 14*a*, which is stored in the computer memory in correlation with its second identification code, relay 14*a* being the relay which received the signal from transmitter 10.

Thus, the authorities at central receiving station 26 are immediately alerted to the fact that transmitter 10 of known identification has sent a signal from the vicinity of relay 14*a*. They can then take appropriate action.

As an added desired feature, each of relays 14*a–e* may contain alarm means 36, which may be audio, visual, or both as desired. The actuation of alarm 36 controlled by receiver 38 which, in turn, may be actuated by transmitter 20 via conductor 40. However, a connection between receiver-decoder 18 and alarm 38 is also provided by conductor 42. Alarm receiver 38 carries appropriate and conventional circuitry so that if a signal has been received from receiver 18 through conductor 42, for example within some predetermined, prior time indicating that the signal from transmitter 10 was directly received by receiver-decoder 18, alarm receiver 38 will not actuate alarm 36 despite the signal from transmitter 20 through conductor 40. Signals from other relays may also be distinguishable by use of a different frequency or code, so that such signals do not activate receiver-decoder 18 to block actuation of alarm 36.

Thus, in this circumstance, relay 14*a* will not sound alarm 36. However, the signal from transmitter 20 may be received by nearby relays 14*b–e* which may be of substantially identical construction to relay 14*a*. These relays 14*b*–14*e* may be too far away to pick-up the signal from transmitter 10. Thus their respective alarms will be actuated, so that the alert will be sounded in an area adjacent to the present location of the transmitter 10, but not exactly at the location of transmitter 10. Thus criminals may not be alerted to the fact that the alert has been sounded.

Additionally, a video camera 44, positioned to record a predetermined view, may be connected to receiver-decoder 18 through conductor 46, so that when a signal is received by receiver-decoder, a corresponding signal is passed through conductor 46 to actuate video camera 44 for a predetermined length of time. If desired, the video signal may pass through conductor 48 to transmitter 20, or another transmitter, if desired, for immediate transmission to central station 26. A similar set-up may be provided for a second video camera 50 pointing in another direction, if desired.

It should be understood that central station 26 is not necessarily physically central within the respective transmitters, but is simply central in terms of the flow of signals.

Test transmitter 52 may carry antenna 54 to transmit radio signals which may be picked up by relays 14*a–e*. The test transmitter may have an identification code, and each receiver-decoder 18 may carry a microprocessor function which is actuated by that identification code and no other, to inhibit the sounding of an alarm. Instead, a different signal may be sent through conductor 22 to transmitter encoder 20 which characterizes proper test operation of each relay 14*a–e* without sounding an alarm.

Additionally, radio operated burglar or fire alarms 56 may be provided as well, to be actuated by receiving a signal from any of relays 14*a*–14*e*.

Thus, the security and communication system disclosed herein can provide immediate indication of troubles over a wide area, including the location of the trouble and the identification of the person sounding the alarm.

The above has been offered for illustrative purposes only, and is not intended to limit the scope of the invention of this application, which is as defined in the claims below.

That which is claimed is:

1. A security and communication system, which comprises:

at least one portable radio frequency transmitter having means for sending a first signal including a first individual identification code to identify the portable transmitter, when actuated by the user;

a plurality of radio frequency relays, each positioned in a predetermined location and having means for receiving said first signal and immediately transmitting a second signal including said first identification code and a second identification code to identify the individual relay that is transmitting the second signal;

each of said relays having alarm means for actuation in response to receipt of said second signal from another relay; each of said relays also having means for inhibiting its alarm in response to receipt of said first signal, whereby the relay directly receiving said first signal has its alarm inhibited while the alarm means of the other relays are not inhibited.

2. The system of claim 1 in which said radio frequency relays are spread out in their positions so that only no more than relatively few of said plurality of relays can be simultaneously actuated by receiving said first signal from the same portable transmitter, whereby the general location of the signaling portable transmitter can be established.

3. The system of claim 2 including central means including microprocessor means for identifying and reporting the location of any said relay activated and the identity of the transmitter sending the signal.

4. The system of claim 1 including a plurality of said radio frequency transmitters, each of a size small enough to be carryable by individual users.

5. The system of claim 1 in which means are provided to cause said alarm means to identify the relay directly receiving the first signal.

6. The system of claim 1 including video recorder means, and means for actuating said video recorder means when a radio frequency relay receives a first signal.

7. The system of claim 1 in which said first signal is in the form of a coded pulse of the duration of a fraction of a second, and said relays have memory means to receive and to store a plurality of differing first signals, and sequential transmission means to cause said relays to sequentially transmit in the second signal the various first identification codes of the stored first signals.

8. A security and communication system which comprises:

a plurality of radio frequency transmitters, each of a size small enough to be carryable by individual users, and having means for sending a first signal including a first individual identification code to identify the portable transmitter, when actuated by the user;

a plurality of radio frequency relays, each positioned in a predetermined location and having means for receiving said first signal and immediately transmitting a second signal including said first identification code and a second identification code to identify the individual relay that is transmitting the second signal;

said radio frequency relays being spread out in their positions so that no more than relatively few of said plurality of relays can be simultaneously actuated by receiving said first signal from the same portable transmitter, whereby the general location of the signaling portable transmitter can be established;

each of said relays having alarm means for actuation in response to receipt of said second signal from another relay; each of said relays also having means for inhibiting its alarm in response to receipt of said first signal, whereby the relay directly receiving said first signal has its alarm inhibited while the alarm means of the other relays are not inhibited; and central means for receiving the signals form said radio frequency relays.

9. The system of claim 8 in which said first signal is in the form of a coded pulse of the duration of a fraction of a second, and said relays have memory means to receive and to store a plurality of differing first signals, and sequential transmission means to cause said relays to sequentially transmit in the second signal the various first identification codes of the stored first signals.

10. The system of claim 9 in which said central means includes microprocessor means for identifying and reporting the location of any said relay activated and the identity of the transmitter sending the signal.

11. The system of claim 8 in which means are provided to cause said audible alarm to identify the relay directly receiving the first signal.

12. The system of claim 11 including video recorder means, and means for actuating said video recorder means when a radio frequency relay receives a first signal.

13. A security and communication system, which comprises:

at least one portable radio frequency transmitter having means for sending a first signal including a first individual identification code to identify the portable transmitter, when actuated by the user;

a plurality of radio frequency relays, each positioned in a predetermined location and having means for receiving said first signal and immediately transmitting a second signal including said first identification code and a second identification code to identify the individual relay that is transmitting the second signal, said radio frequency relays being spread out in their positions so that only no more than relatively few of said plurality of relays can be simultaneously actuated by receiving said first signal from the same portable transmitter, whereby the general location of the signaling portable transmitter can be established;

each of said relays having alarm means for actuation in response to receipt of said second signal from another relay; each of said relays also having means for inhibiting its alarm in response to receipt of said first signal, whereby the relay directly receiving said first signal has its alarm inhibited while the alarm means of the other relays are not inhibited;

14. The system of claim 13 in which means are provided to cause said audible alarm to identify the relay directly receiving the first signal.

15. The system of claim 14 including video recorder means, and means for actuating said video recorder means when a radio frequency relays receives a first signal.

16. In a security and communciation syste, a plurality of radio frequendy relays, each positioned in a predetermined location and having means for receiving a first signal and immediately transmitting a second signal plus an identification code to identify the individual relay that is transmitting the second signal, said radio frequency relays being spread out in their positions so that only no more than relatively few of said plurality of relays can be simultaneously actuated by receiving a first signal from a portable transmitter, whereby the general location of the signaling portable transmitter can be established; each of said relays having alarm means for actuation in response to receipt of said second signal from another relay; each of said relay also having means for inhibiting its alarm in response to receipt of said first signal, whereby the relay directly receiving said first signal has its alarm inhibited while the alarm means of the other relays are not inhibited.

17. The system of claim 16 including control means for receiving signals from radio frequency relays, said control means including microprocessor means for identifying and reporting the location of any said relay activated.

18. The system of claim 16 in which means are provided to cause said alarm means to identify the relay directly receiving the first signal.

19. The system of claim 16 including video recorder means, and means for actuating said video recorder means when a radio frequency relay receives a first signal.

* * * * *